US012601192B2

(12) United States Patent
Gee et al.

(10) Patent No.: US 12,601,192 B2
(45) Date of Patent: Apr. 14, 2026

(54) CONCRETE VIBRATOR SYSTEM

(71) Applicant: MILWAUKEE ELECTRIC TOOL CORPORATION, Brookfield, WI (US)

(72) Inventors: Kevin R. Gee, New Berlin, WI (US); Carissa J. Minkebige, Lake Mills, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 80 days.

(21) Appl. No.: 18/685,597

(22) PCT Filed: Aug. 25, 2022

(86) PCT No.: PCT/US2022/041488
§ 371 (c)(1),
(2) Date: Feb. 22, 2024

(87) PCT Pub. No.: WO2023/028206
PCT Pub. Date: Mar. 2, 2023

(65) Prior Publication Data

US 2024/0392590 A1 Nov. 28, 2024

Related U.S. Application Data

(60) Provisional application No. 63/237,372, filed on Aug. 26, 2021.

(51) Int. Cl.
*E04G 21/08* (2006.01)

(52) U.S. Cl.
CPC ..... *E04G 21/08* (2013.01)

(58) Field of Classification Search
None
See application file for complete search history.

(56) References Cited

U.S. PATENT DOCUMENTS 6,223,871 B1 5/2001 Steffen
7,044,413 B2 5/2006 Steffen
(Continued)

FOREIGN PATENT DOCUMENTS

CN 102051979 A 5/2011
CN 205476513 U 8/2016
(Continued)

OTHER PUBLICATIONS

Tanaka JPH07233638A Translation 1995 (Year: 1995).*
(Continued)

*Primary Examiner* — Jacob T Minskey
*Assistant Examiner* — Adrien J Bernard
(74) *Attorney, Agent, or Firm* — Michael Best & Friedrich LLP

(57) ABSTRACT

A concrete vibrator system comprising a vibrating head, a power box, a first cable, and a storage cart. The vibrating head includes a shaft and a motor. The shaft has a center of mass radially offset from a rotational axis of the shaft. The first cable is coupled to vibrating head at a first end thereof. The first cable is configured to transmit electrical current to the motor. The first cable has a first length extending from the vibrating head to an opposite, second end of the first cable. The storage cart includes a frame, a second cable, and a drum. The second cable is connectable to the first cable and the power box. The second cable has a second length greater than the first length. The drum is supported by the frame, and the second cable is selectively wrapped around and selectively extendible from the drum.

20 Claims, 3 Drawing Sheets

(56) References Cited

U.S. PATENT DOCUMENTS

| | | | |
|---|---|---|---|
| 2014/0241105 | A1 | 8/2014 | Jin |
| 2019/0006980 | A1 | 1/2019 | Sheeks et al. |
| 2019/0210078 | A1 | 7/2019 | Davies et al. |
| 2021/0148126 | A1 | 5/2021 | Gallagher et al. |

FOREIGN PATENT DOCUMENTS

| | | | |
|---|---|---|---|
| CN | 106088614 | A | 11/2016 |
| CN | 205935699 | U | 2/2017 |
| CN | 208456144 | U | 2/2019 |
| CN | 210177970 | U | 3/2020 |
| CN | 210918268 | U | 7/2020 |
| CN | 211201198 | U | 8/2020 |
| CN | 211257864 | U | 8/2020 |
| CN | 211548824 | U | 9/2020 |
| CN | 211597769 | U | 9/2020 |
| CN | 211873874 | U | 11/2020 |
| DE | 7312577 | U | 7/1973 |
| DE | 20000037 | U1 | 5/2000 |
| EP | 0985782 | A1 | 3/2000 |
| JP | H07233638 | A | 9/1995 |
| JP | H08105040 | A | 4/1996 |
| JP | H08158651 | A | 6/1996 |
| JP | H09291703 | A | 11/1997 |
| KR | 1020090062909 | A | 6/2009 |
| WO | 0022257 | A1 | 4/2000 |

OTHER PUBLICATIONS

Kobayashi JPH08158651A Translation 1996 (Year: 1996).*

International Search Report and Written Opinion for Application No. PCT/US2022/041488 dated Dec. 27, 2022 (11 pages).

Milwaukee Electric Tool, "MX Fuel™ Sewer Drum Machine w/ Powertredz™ for ⅝"-¾" Cable Kit," <https://www.milwaukeetool.com/Products/Equipment/Drain-Cleaning/MXF501-1CP> web page visited Feb. 29, 2024 (21 pages).

* cited by examiner

CONCRETE VIBRATOR SYSTEM

CROSS-REFERENCE TO RELATED APPLICATIONS

This application is a national stage filing under 35 U.S.C. § 371 of International Application No. PCT/US2022/041488 filed on Aug. 25, 2022, which claims priority to U.S. Provisional Patent Application No. 63/237,372 filed on Aug. 26, 2021, the entire contents of each of which are incorporated herein by reference.

FIELD OF THE INVENTION

The present invention relates to power tools, and more particularly to concrete vibrators.

BACKGROUND OF THE INVENTION

Concrete vibrators are typically used to spread poured concrete around a framework, such as rebar, in a construction operation. Such concrete vibrators are typically heavy and require frequent lifting to move the concrete vibrator around sites within a construction zone.

SUMMARY OF THE INVENTION

The present invention provides, in one aspect, a concrete vibrator system comprising a vibrating head, a power box, a first cable, and a storage cart. The vibrating head includes a shaft and a motor. The shaft is configured to rotate about a rotational axis, and has a center of mass radially offset from the rotational axis. The motor is configured to provide torque to cause the shaft to rotate. The power box includes a battery pack. The first cable is coupled to vibrating head at a first end thereof. The first cable is configured to transmit electrical current to the motor. The first cable has a first length extending from the vibrating head to an opposite, second end of the first cable. The storage cart includes a frame, a second cable, and a drum. The second cable has a first end connectable to the first cable and an opposite, second end connectable to the power box. The second cable has a second length greater than the first length. The drum is supported by the frame, and the second cable is selectively wrapped around and selectively extendible from the drum.

The present invention provides, in another aspect, a storage cart configured to be coupled to a vibrating head. The storage cart includes a frame, a battery pack, a cable, a drum, and a wheel. The battery pack is supported by the frame. The cable has a first end connectable to the vibrating head and an opposite, second end configured to receive electrical current from the battery pack. The cable is configured to transmit the electrical current to the vibrating head. The drum is supported by the frame. The cable is selectively wrapped around and selectively extendible from the drum. The wheel is rotatably coupled to the frame to facilitate transport of the storage cart along a surface.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
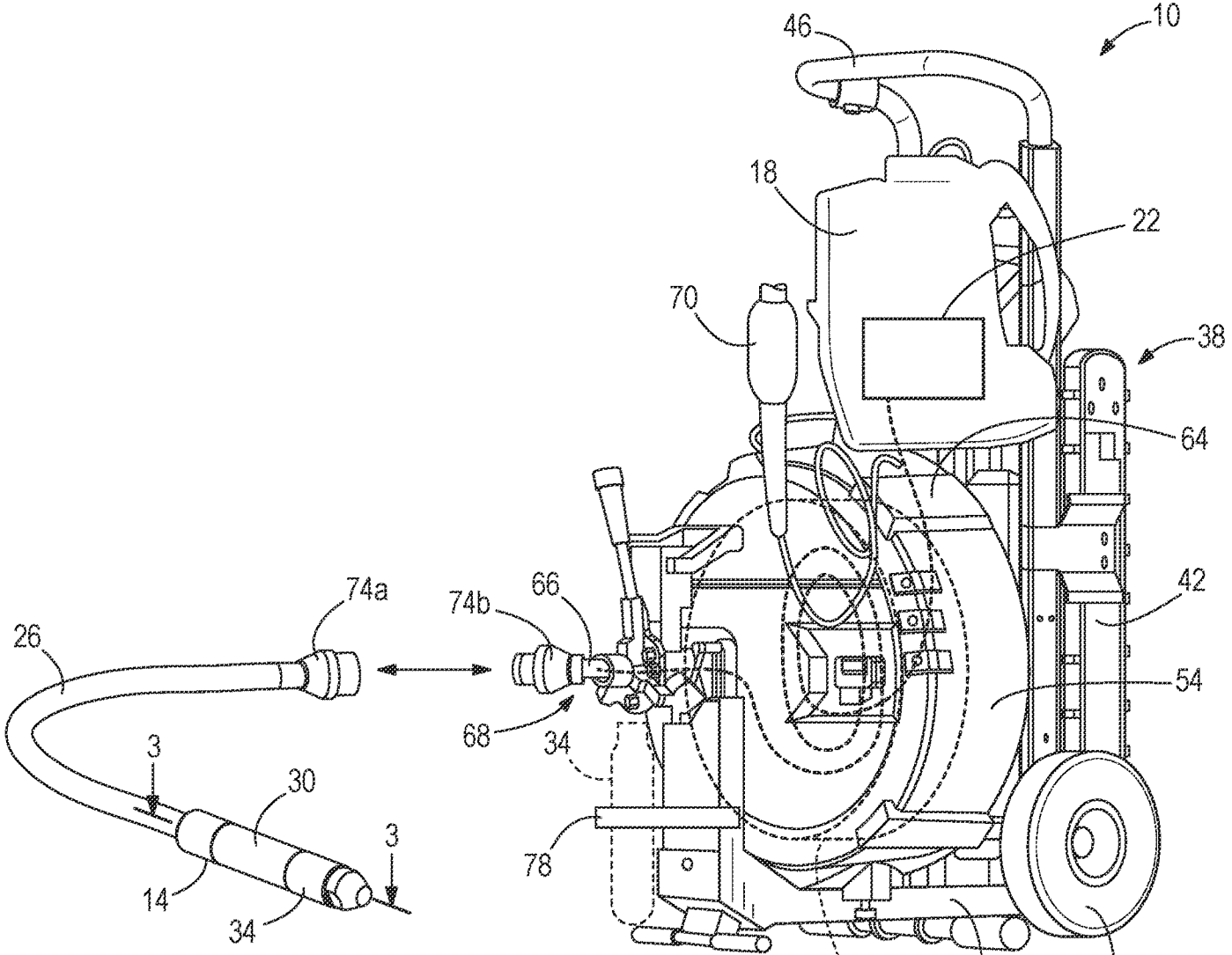
FIG. 1 is a perspective view of a concrete vibrator in accordance with a first embodiment of the invention.

As shown in FIG. 1, a concrete vibrator 10 includes a vibrating head 14 (also illustrated in FIG. 3), a power box 18 (also illustrated in FIG. 2) having an onboard power source (e.g., a battery pack 22) and associated control electronics (not shown), and a first whip or cable 26 connected with the vibrating head 14 to provide electrical current thereto from the battery pack 22. The vibrating head 14 includes a motor (e.g., a brushless direct-current electric motor 30) and a shaft 34 having a center of mass radially offset from a rotational axis of the shaft 34 to create vibration in response to rotation of the shaft about its rotational axis. In the illustrated embodiment, the motor 30 includes a motor output shaft 32 directly connected to the shaft 34 to provide torque thereto, causing the shaft 34 to rotate (See FIG. 3). In other embodiments, an intermediate gear train 33 may be used between the motor 30 and the shaft 34 to adjust the speed and torque provided to the shaft 34.

In some embodiments, the battery pack 22 and the motor 30 can be configured as a high-power battery pack 22 and motor 30, such as the 80 Volt battery pack and motor disclosed in U.S. patent application Ser. No. 16/025,491, filed on Jan. 3, 2019, and published as U.S. Patent Application No. 2019/0006980, the entirety of which is incorporated herein by reference. In such a battery pack, the battery cells within the battery pack have a nominal voltage of up to about 80 V. In some embodiments, the battery cells are operable to output a sustained operating discharge current of between about 40 A and about 60 A. In some embodiments, each of the battery cells has a capacity of between about 3.0 Ah and about 5.0 Ah. And, in some embodiments of the motor 30 when used with the 80 Volt battery pack, the motor 30 has a power output of at least about 2760 W and a nominal outer diameter (measured at the stator) of up to about 80 mm.

The concrete vibrator 10 may be used in various sites, and it may be beneficial for a user to easily transport either the concrete vibrator 10 or only the vibrating head 14 between the various sites. The concrete vibrator 10 further includes a storage cart 38 having a frame 42, a handle 46, and a base 50. The frame 42 defines an elongated body extending between the handle 46 and the base 50. The handle 46 is positioned on a top end of the frame 42 to enable a user to grip and control movement of the cart 38. In the embodiment illustrated of FIG. 1, the base 50 supports a drum housing 54 and the power box 18 is supported by the frame 42. Additionally, the illustrated concrete vibrator 10 includes wheels 58 rotatably coupled to the frame 42 to also assist with transport of the concrete vibrator 10 along a surface.

In the illustrated embodiment, a drum 62 is rotatably supported within the drum housing 54 and includes a second whip or cable 66 that is extendable from an opening 68 in the drum housing 54. In some embodiments, the drum 62 is a cage-style drum such that when the drum housing 54 is opened, the drum 62 is easily accessible so a user can inspect the second cable 66. In some embodiments, a top portion 64 of the drum housing 54 may be removable to access the drum 62 and the wound second cable 66 to clean accumulated concrete from the second cable 26. In some embodiments, the second cable 66 may be extendable from the drum housing 54 by rotating the drum 62 with a cable feed device (not shown) and, in some embodiments, the second cable 66 may be retractable into the drum housing 54 by rotating the drum 62 with a cable retraction device (not shown). Such a cable feed device and cable retention device are disclosed in U.S. patent application Ser. No. 16/241,361, filed on Jan. 7, 2019, and published as U.S. Patent Application No. 2019/0210078, the entire content of which is incorporated herein by reference.

In such an embodiment of the concrete vibrator 10 including a cable feed and/or cable retention device, a separate motor (e.g., a brushless direct current electric motor, not shown) may be provided within the drum housing 54 to rotate the drum 62 using electrical current received from the power box 18. In some embodiments, the power box 18 may be removably secured to the frame 42. When connected to the frame 42, the power box 18 may be electrically connected to the drum motor while also being electrically connected to the second cable 66 within the drum housing 54 to provide power and control signals to the vibrating head 14 to drive the motor 30. If desired to use the vibrating head 14 without the cart 38, an operator can remove the power box 14 and directly attach the first cable 26 to the power box 18 to directly receive electrical current and control signals therefrom.

Figure 2:
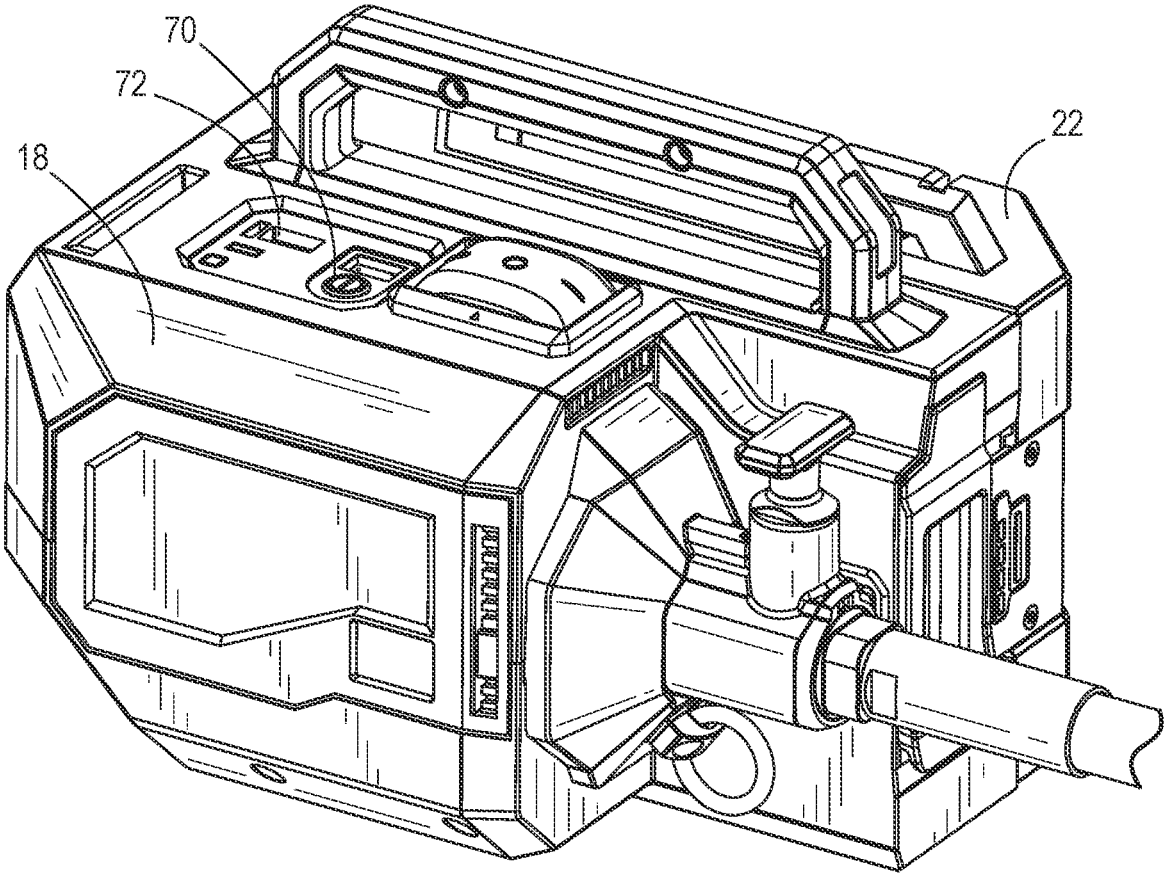
FIG. 2 is a perspective view of a power box of the concrete vibrator of FIG. 1.
Figure 3:
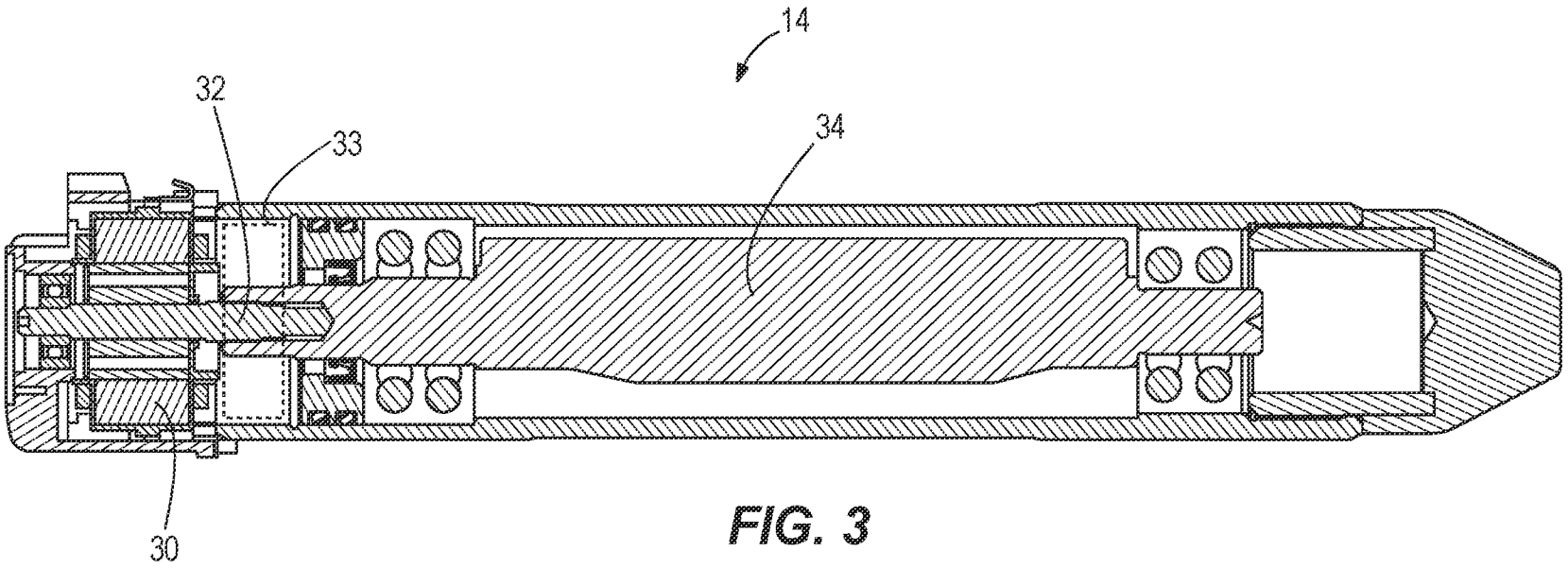
FIG. 3 is a cross-sectional view of a vibrating head of the concrete vibrator of FIG. 1 taken along section line 3-3 in FIG. 1.

In some embodiments, rather than the control electronics for the vibrating head 14 being incorporated in the power box 18, a separate electronic control unit or controller 70 inline with the second cable 66 and the power box 18 (which may then only include the battery pack 22) may be used to provide control signals to the vibrating head 14 control operation of the motor 30. In such an embodiment, the controller 70 may be tethered to the power box 18, the drum housing 54, or the cart 38. As such, a user holding the cables 26, 66 and directing the vibrating head 14 may also hold the controller 70 to adjust the frequency and/or magnitude of vibration of the vibrating head 14. Alternatively, as illustrated in FIG. 2, the controller 70 may be integrated with the power box 18. The controller 70 may include a user interface 72 for adjusting the operational parameters of the vibrating head 14.

With continued reference to FIG. 1, an end of the first cable 26 opposite the vibrating head 14 includes a connector 74*a*. And, an end of the second cable 66 protruding from the drum housing 54 includes a mating connector 74*b*. The connectors 74*a*. 74*b*, when connected to each other, secure the cables 26, 66 to each other and transmit electrical current and control signals from the second cable 66 to the first cable 26. The end of the second cable 66 opposite the connector 74*b*, in turn, is electrically connected to the power box 18 (and optionally the inline controller 70 if used). As such, the second cable 66 functions as an extension to the first cable 26 for transmitting electrical current and control signals for driving the motor 30 from the power box 18 (or alternatively the inline controller 70 if used).

The connector 74*b* may be dimensioned larger than the opening 68 into the drum housing 54 to prevent the connector 74*b* from being retracted into the drum housing 54 when the drum 62 is retracted. In other embodiments, the first cable 26 may be dimensioned larger than the opening 68 into the drum housing 54. In some embodiments, the opening 68 may have an inlet diameter between 20 mm and 30 mm. In other embodiments, the opening 68 may have an inlet diameter between 25 mm and 29.5 mm. In the illustrated embodiment, the opening 68 includes an inlet diameter of 29 mm. In some embodiments, the first cable 26 has an outer diameter between 30 mm and 60 mm. In other embodiments, the first cable 26 has an outer diameter between 30 mm and 50 mm, and preferably, between 30 mm and 40 mm. In some embodiments, the vibrating head 14 includes an outer diameter between 25.4 mm (1 inch) and 101.6 mm (4 inches). In other embodiments, the vibrating head 14 includes an outer diameter between 50.8 mm (2 inches) and 76.2 mm (3 inches), and preferably, about 58.42 mm (2.3 inches).

When the vibrating head 14 is not in use and the concrete vibrator 10 is being transported between sites, the second cable 66 may be wound within the drum 62 and stored in the drum housing 54. In some embodiments, the axial length of the second cable 66 is dimensioned such that between one and ten coils of the second cable 66 may be wrapped around the drum 62, and preferably, three coils of the second cable 66 may be wrapped around the drum 62 and stored in the drum housing 54.

When the second cable 66 is retracted within the drum housing 54, the vibrating head 14 and the first cable 26 may hang freely by the connectors 74*a*, 74*b*. The concrete vibrator 10 may be further provided with a strap 78 to secure the vibrating head 14 to the frame 42 or another portion of the concrete vibrator 10. Such a strap 78 may prevent free movement of the vibrating head 10 during transport of the concrete vibrator 10.

Although the invention has been described in detail with reference to certain preferred embodiments, variations and modifications exist within the scope and spirit of one or more independent aspects of the invention as described.

Various features of the invention are set forth in the following claims.

What is claimed is:

1. A concrete vibrator system comprising:

a vibrating head including a shaft configured to rotate about a rotational axis, the shaft having a center of mass radially offset from the rotational axis, and a motor configured to provide torque to cause the shaft to rotate;

a power box including a battery pack;

a first cable coupled to the vibrating head at a first end thereof and configured to transmit electrical current to the motor, the first cable having a first length extending from the vibrating head to an opposite, second end of the first cable; and a storage cart including a frame, a second cable having a first end connectable to the first cable and an opposite, second end connectable to the power box, the second cable having a second length greater than the first length, and a drum supported by the frame, the second cable being selectively wrapped around and selectively extendible from the drum.

2. The concrete vibrator system of claim 1, wherein the first cable includes a first connector located on the first end of the first cable, and the second end of the second cable includes a second connector, the first connector and the second connector being removably coupled to each other.

3. The concrete vibrator system of claim 1, wherein the storage cart further comprises a drum motor configured to rotate the drum.

4. The concrete vibrator system of claim 1, wherein the storage cart further comprises a drum housing surrounding the drum, the drum housing being supported by the frame, the drum housing having an opening, the drum being rotatably supported within the drum housing such that the second cable is extendable from the opening.

5. The concrete vibrator system of claim 4, wherein a portion of the drum housing is removable to access at least one of the drum or the second cable.

6. The concrete vibrator system of claim 4, wherein the opening has a first size, and wherein the first cable has a second size larger than the first size.

7. The concrete vibrator system of claim 6, wherein first size of the opening is between 20 mm and 30 mm.

8. The concrete vibrator system of claim 6, wherein the second size of the first cable is between 30 mm and 60 mm.

9. The concrete vibrator system of claim 1, further comprising a controller electrically coupled to the power box and configured to adjust an operating parameter of the vibrating head.

10. The concrete vibrator system of claim 1, wherein the motor is directly connected to the shaft.

11. The concrete vibrator system of claim 1, wherein the second length is dimensioned such that between 1 and 10 coils of the second cable can be wrapped around the drum.

12. The concrete vibrator system of claim 1, wherein the storage cart further comprises a strap configured to secure the vibrating head to the frame.

13. A storage cart configured to be coupled to a vibrating head, the storage cart comprising:

a frame;

a battery pack supported by the frame;

a cable having a first end connectable to the vibrating head and an opposite, second end configured to receive electrical current from the battery pack, the cable being configured to transmit the electrical current to the vibrating head;

a drum supported by the frame, the cable being selectively wrapped around and selectively extendible from the drum; and a wheel rotatably coupled to the frame to facilitate transport of the storage cart along a surface.

14. The storage cart of claim 13, wherein the vibrating head is connected to a first connector and the first end of the cable includes a second connector, the first connector and the second connector being removably coupled to each other.

15. The storage cart of claim 13, further comprising a drum motor configured to rotate the drum.

16. The storage cart of claim 13, wherein the storage cart further comprises a drum housing surrounding the drum, and wherein a portion of the drum housing is removable to access at least one of the drum or the cable.

17. The storage cart of claim 13, wherein the storage cart further comprises a drum housing surrounding the drum, and wherein the drum housing includes an opening having a first size through which the cable is extendible, and wherein the vibrating head has a second size larger than the first size.

18. The storage cart of claim 13, further comprising a controller electrically coupled to the battery pack and configured to adjust an operating parameter of the vibrating head.

19. The storage cart of claim 18, wherein the controller is configured to output a control signal through the cable to the vibrating head.

20. The storage cart of claim 13, wherein the cable has a length sufficient to wrap between 1 and 10 coils of the cable around the drum.

* * * * *